US008267774B2

(12) United States Patent
Englman et al.

(10) Patent No.: US 8,267,774 B2
(45) Date of Patent: Sep. 18, 2012

(54) WAGERING GAMING WITH INTER-PLAYER COMPETITION FEATURE

(75) Inventors: Allon G. Englman, Chicago, IL (US); Mark B. Gagner, West Chicago, IL (US); Jeremy M. Hornik, Chicago, IL (US); Joel R. Jaffe, Glenview, IL (US); Larry J. Pacey, Chicago, IL (US); Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 532 days.

(21) Appl. No.: 12/513,644

(22) PCT Filed: Nov. 5, 2007

(86) PCT No.: PCT/US2007/023264

§ 371 (c)(1),
(2), (4) Date: May 5, 2009

(87) PCT Pub. No.: WO2008/063395

PCT Pub. Date: May 29, 2008

(65) Prior Publication Data

US 2010/0056261 A1 Mar. 4, 2010

Related U.S. Application Data

(60) Provisional application No. 60/858,205, filed on Nov. 10, 2006.

(51) Int. Cl.
*A63F 9/24* (2006.01)

(52) U.S. Cl. ..... 463/23

(58) Field of Classification Search ..... 463/20, 463/23, 25

See application file for complete search history.

(56) References Cited

U.S. PATENT DOCUMENTS

| | | | | |
|---|---|---|---|---|
| 6,588,754 | B1 | 7/2003 | Adams et al. | 427/470 |
| 2003/0114218 | A1 | 6/2003 | McClintic | 463/25 |
| 2003/0224851 | A1 | 12/2003 | Gilmore | 463/20 |
| 2005/0003886 | A1 | 1/2005 | Englman et al. | 463/25 |
| 2005/0037838 | A1 * | 2/2005 | Dunaevsky et al. | 463/25 |
| 2005/0245307 | A1 | 11/2005 | Gatto et al. | 463/16 |
| 2005/0261055 | A1 * | 11/2005 | Casey et al. | 463/20 |

OTHER PUBLICATIONS

PCT International Search Report for International Application No. PCT/US2007/023264 dated Jul. 18, 2008 (3 pages).
PCT Written Opinion for International Application No. PCT/US2007/023264 dated Jul. 18, 2008 (5 pages).

* cited by examiner

*Primary Examiner* — Brook Kebede
(74) *Attorney, Agent, or Firm* — Nixon Peabody LLP

(57) ABSTRACT

A variety of inter-player competition features for incorporation into a gaming system are disclosed. In one embodiment, a gaming system is provided with a trail-based game and comprises a plurality of gaming machines, signage, and at least one controller. The community event is triggered by an underlying wagering game. The controller is operative to conduct a trail-based game including a token and a trail having a plurality of steps, mark one or more of the plurality of steps with a marker, display a token on at least one of the steps, reduce an award value for the step on which the token is displayed when the step is marked by one or more marker. The award value being reduced for each of the plurality of players whose marker does not mark the step.

18 Claims, 10 Drawing Sheets

WAGERING GAMING WITH INTER-PLAYER COMPETITION FEATURE

CROSS REFERENCE TO RELATED APPLICATIONS

This application is a U.S. national stage of International Application No. PCT/US2007/023264, filed Nov. 5, 2007, which is related to and claims priority to U.S. Provisional Application No. 60/858,205, filed Nov. 10, 2006, which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to wagering games having competitive or collaborative features among players.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the present invention, a method of conducting a wagering game on a gaming system is disclosed. A trail-based game is initiated. The trail-based game is triggered during play of an underlying wagering game and includes a trail having a plurality of steps. The trail-based game further includes a token being adapted to move along the trail. One or more markers are provided to each of a plurality of players. Each of the one or more markers is adapted to mark at least one of the plurality of steps within the trail. At least one marked step along the trail is identified for each of the plurality of players. The token is stopped on at least two of the plurality of steps along the trail and an award value is determined for each of the steps on which the token stops. At least a portion of the award value is reduced to one or more of the plurality of players when another of the plurality of players has marked that step.

According to another aspect of the present invention, a method of conducting a wagering game on a gaming system is disclosed. A trail-based game is initiated including a token and a trail, which has a plurality of steps. One or more markers are provided to each of a plurality of players. Each of the one or more markers is adapted to mark at least one of the plurality of steps within the trail. At least one step along the trail is selected and identified for each of the plurality of players by the one or more markers. The token is moved along the trail and stopped on at least one step along the trail. An award value is reduced to one or more of the plurality of players when another of the plurality of players has marked the at least one step on which the token has stopped.

According to yet another aspect of the invention, a computer readable storage medium is encoded with instructions for directing a gaming system to perform the above method.

According to still another embodiment of the present invention, a gaming system is disclosed. The gaming system comprises a plurality of gaming machines adapted to conduct a wagering game thereon, signage, and at least one controller. The signage displays a community event thereon. The community event is triggered by the underlying wagering game. The at least one controller is in communication with the signage and the plurality of gaming machines. The controller is operative to conduct a trail-based game including a token and a trail having a plurality of steps, mark one or more of the plurality of steps with a marker, display a token on at least one of the steps, reduce an award value for the step on which the token is displayed when the step is marked by one or more marker. The award value being reduced for each of the plurality of players whose marker: does not mark the step.

Additional aspects of the invention will be apparent to those of ordinary skill in the art in view of the detailed description of various embodiments, which is made with reference to the drawings, a brief description of which is provided below.

Figure 1A:
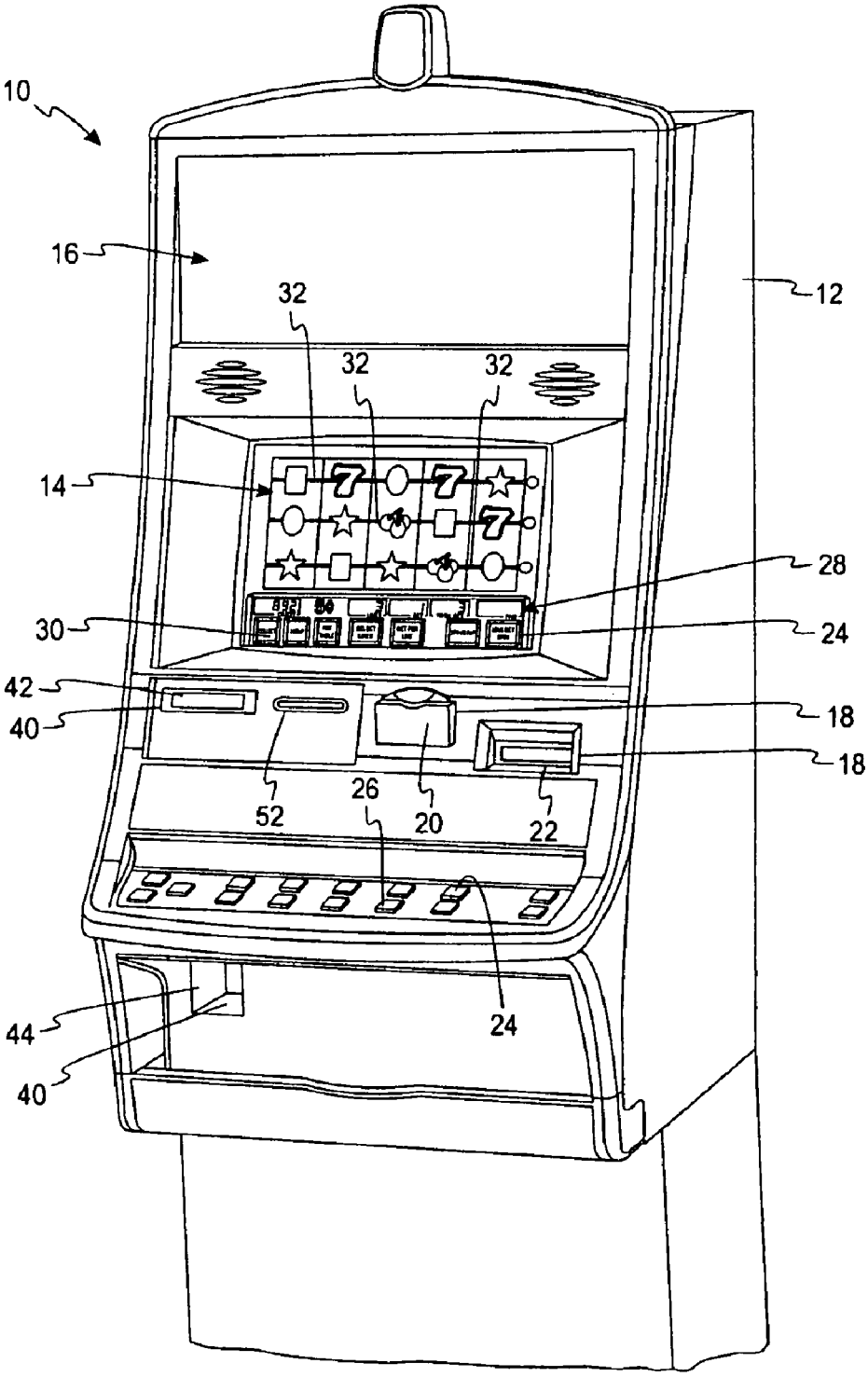
FIG. 1*a* is a perspective view of a free standing gaming machine embodying the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail various embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

Where a digital display is provided, such as a plasma display, the gaming machine 10 may periodically shift the displayed image, microscopically, to avoid "burn in" of the displayed image on the display. This technique is known generally as pixel shifting and keeps the image moving in a way that prevents the burning in of an image while being imperceptible to the human eye.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
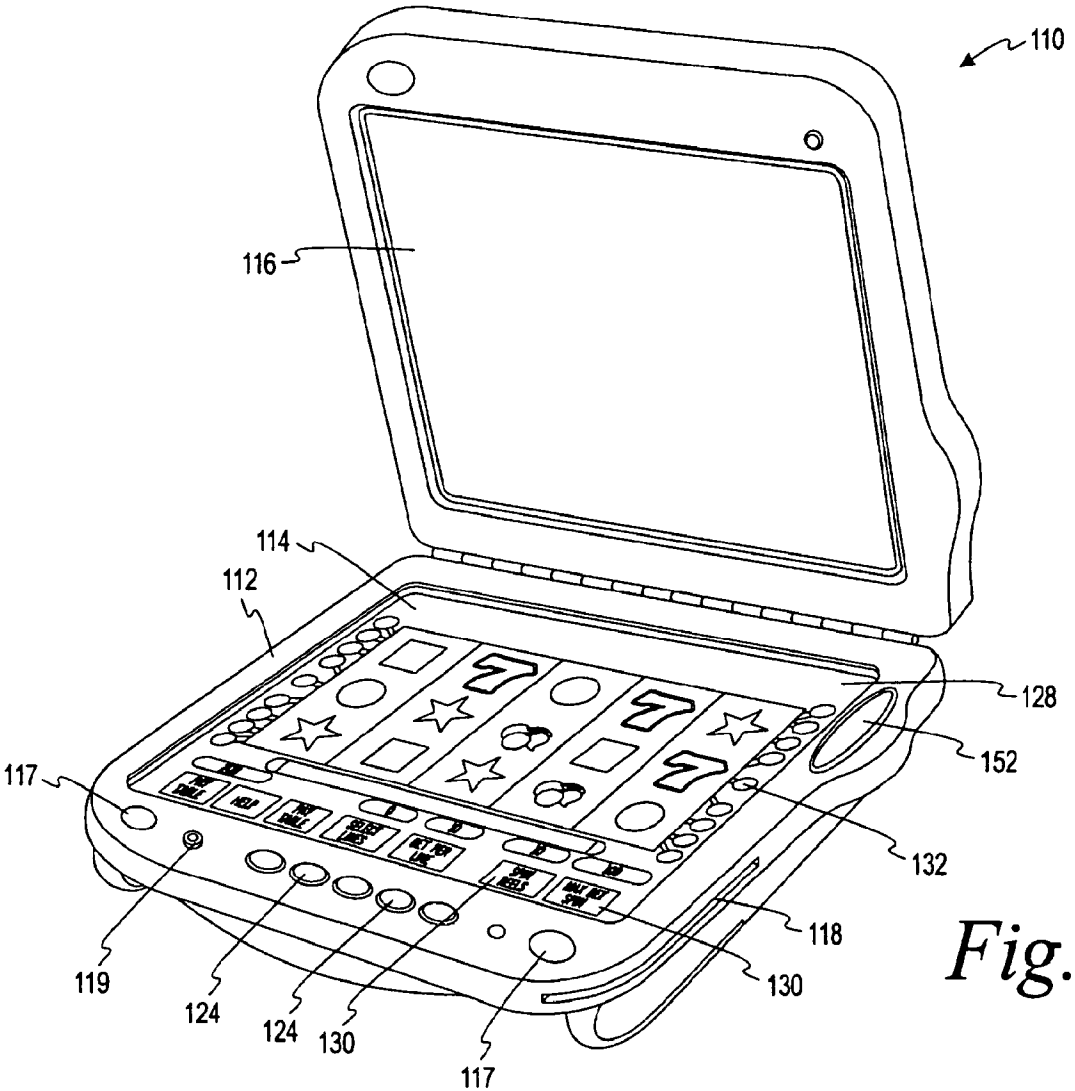
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
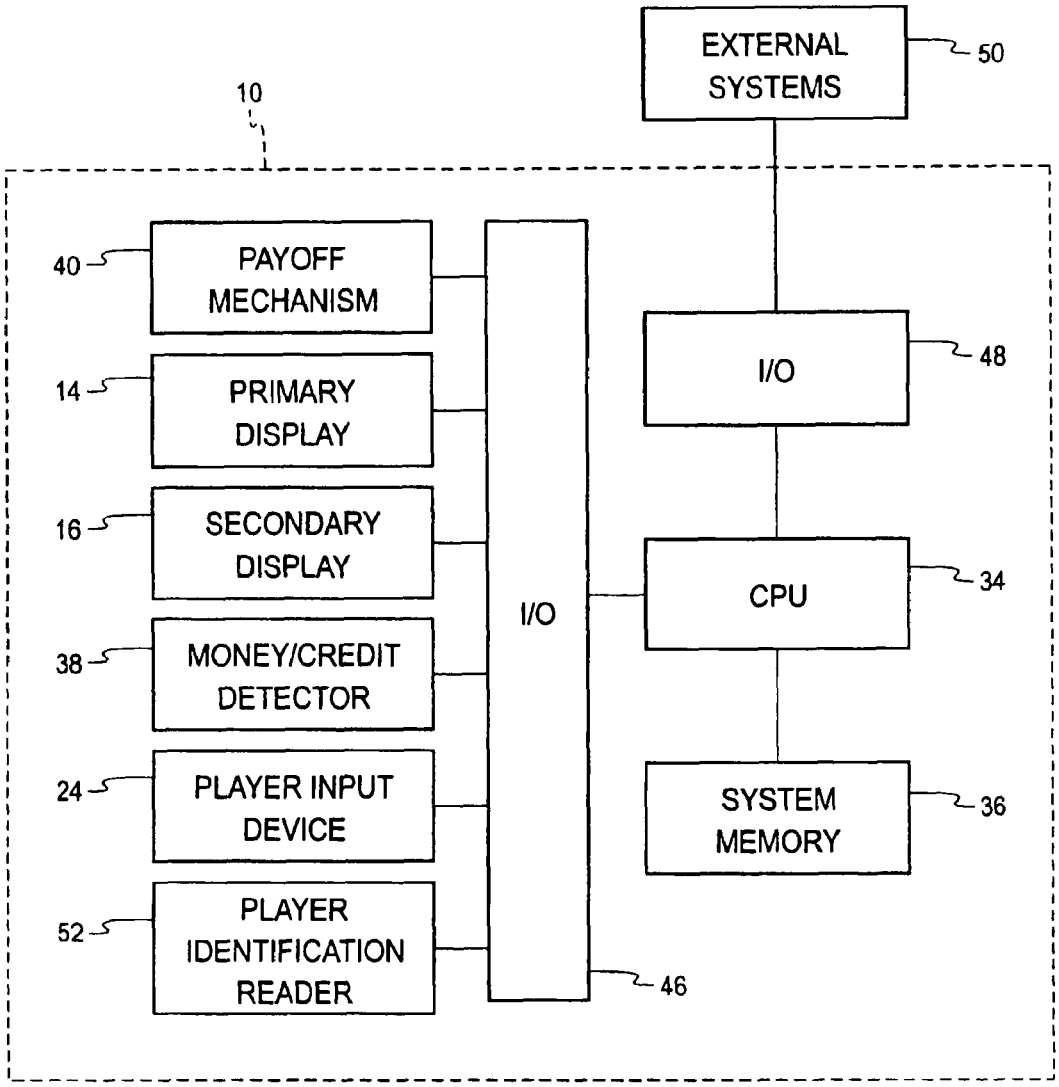
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display (s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
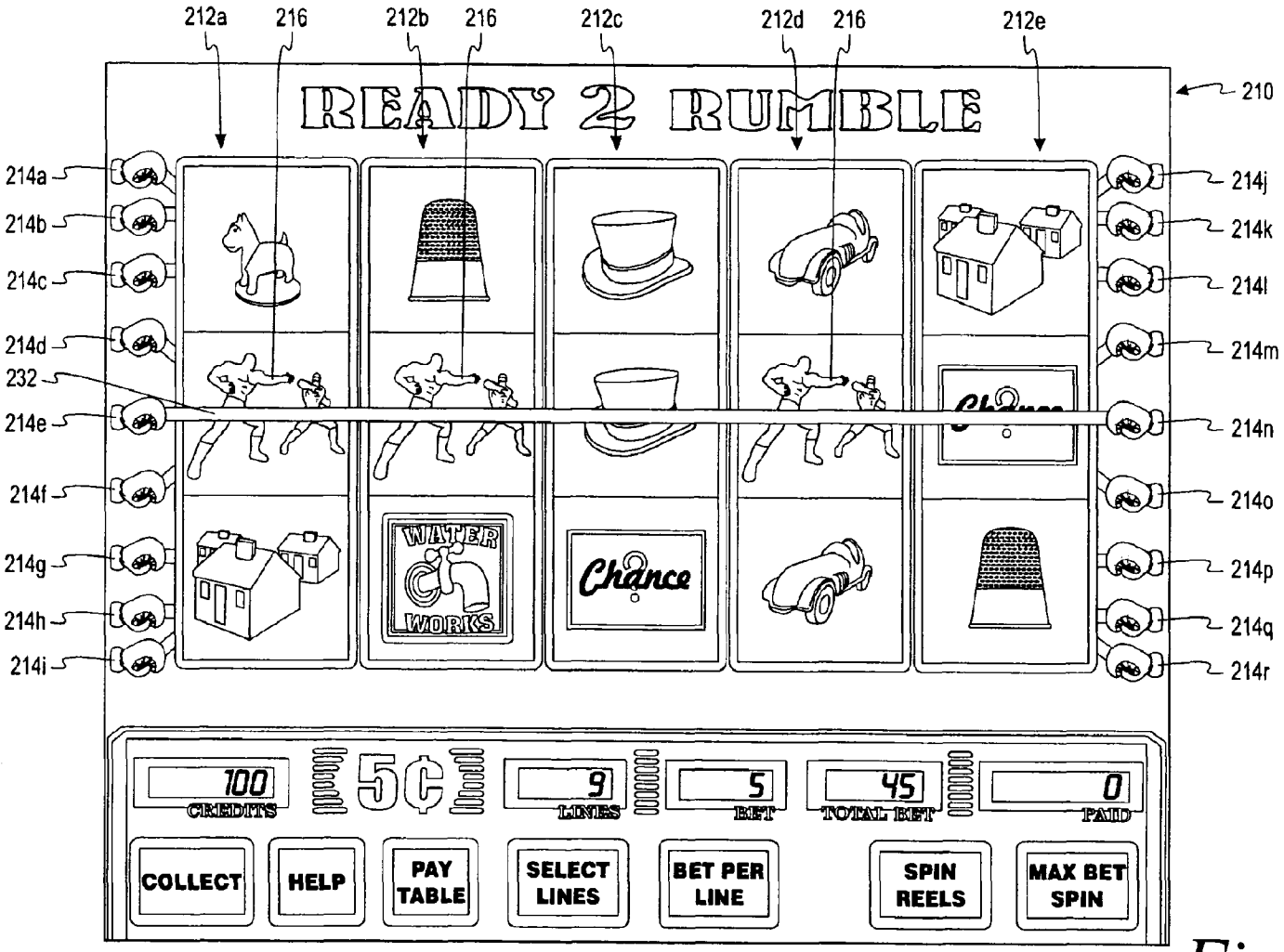
FIG. 3 is an image of a game screen, according to one embodiment of the present invention.

Turning now to FIG. 3, an image of a game screen 210 is illustrated, according to one embodiment of the present invention. A player begins play of a basic wagering game by inserting a wager into the value input device 18, 118 of the gaming machine 10, 110. A player can select play by either using the player input device 24, 124. The controller, or the external systems in alternative embodiments, operates to execute a wagering game program causing the primary display 14, 114 to display the wagering game that includes a plurality of visual elements.

The game screen 210 may be displayed on the primary display 14, 114 or on a portion thereof. In the illustrated embodiment, the game screen 210 is used to display a plurality of simulated, movable reels 212*a-e* with symbols displayed thereon. The reels 212*a-e* are positioned such that the symbols are displayed relative to at least one payline 232, yielding a plurality of outcomes for the wagering game. As illustrated, five reels 212*a-e* each having three visible symbols are displayed on a video display, however, it should be understood that the reels 212*a-e* may also be mechanical reels, and any number of reels and symbols per reel may be utilized.

The game screen 210 may also display a plurality of game session meters and various buttons selectable by a player. The game session meters include a "credit" meter for displaying a number of credits available for play on the machine; a "lines" meter for displaying a number of paylines to be played by a player on the machine; a "line bet" meter for displaying a number of credits wagered (e.g., from 1 to 5 credits) for each of the number of paylines played; a "total bet" meter for displaying a total number of credits wagered for the particular round of wagering; and a "paid" meter for displaying an amount to be awarded based on the results of the particular rounds wager. The user-selectable buttons include a "collect" button to collect the credits remaining in the credits meter 60; a "help" button for viewing instructions on how to play the wagering game; a "pay table" button for viewing a pay table associated with the basic wagering game; a "select lines" button for changing the number of paylines (displayed in the lines meter) a player wishes to play; a "bet per line" button for changing the amount of the wager which is displayed in the line bet meter; a "spin reels" button for moving the reels 212*a-e* ; and a "max bet spin" button for wagering a maximum number of credits and moving the reels 212*a-e* of the wagering game. While the gaming machine 10, 110 allows for these types of player inputs, the present invention does not require them and can be used on gaming terminals having more, less, or different player inputs.

In FIG. 3, the five depicted reels 212*a-e* have a plurality of symbols displayed thereon and at least one activated payline 232 extending from one of the payline indicators 214*a-i* on the left side of the screen 210 to any one of the payline indicators 214*j-r* on the right side of the screen 210. The plurality of symbols displayed on the plurality of reels 212*a-e* are used to indicate a plurality of possible outcomes along each of the activated paylines 232.

The plurality of reels 212*a-e* include one or more trigger symbols 216 that can be displayed on one or more of the reels 212*a-e* . The trigger symbols 216 can be utilized to initiate a special event such as a bonus game, a community game, or any other event involving two or more players on different gaming machines 10, 110. For example, a special event may be initiated when three or more trigger symbols 216 are displayed along a single activated payline 232. Alternatively, a special event may be initiated when one or more trigger symbols 216 are displayed on any of the reels, whether along an activated payline 232 or not.

The special event may create/require competition or collaboration among players at the various gaming machines 10, 110, as will be explained below. When a special event has been initiated, two or more players are selected to participate in the special event. These players are capable of earning various awards over the course of the special event. The players compete for a single award or a portion thereof. Though the initiation of the special event has been described with respect to a slots game, it should be understood to those skilled in the art that the below described special events may be utilized with any type of wagering game.

The special event may end after a particular length of time or a particular number of turns, after a predetermined event has occurred, or when a particular victory condition has been met. At the end of the special event, one or more participants in the special event are provided with an award based on the outcome of the special event. In some embodiments, an award is provided to the "last person standing." In these embodiment, the participants are gradually eliminated until a single player remains. The remaining player may earn the entire award value of the special event or may earn a greater portion or percentage of the available award within the special event. In some embodiments, a player earns an award for achieving the highest score among the participants or for exceeding a predetermined threshold value or ranking. In still other embodiments, the player earns an award upon the completion of a certain predetermined event or outcome.

The award outcome may include any number of various awards, features, or prizes. For example, the winner of a special event may receive a special symbol attribute for use in the underlying wagering game, such as a multiplier, extra wild symbol(s), special reel symbol(s), etc. Additionally or alternatively, the winner of a special event may be awarded additional activated paylines 232 or may be awarded a multiplier on a particular payline. The payline may be a feature of the underlying wagering game or may be a feature of the special event itself.

In some embodiments, a winning player in the special event may not necessarily be granted the highest award value. For example, the winner of the special event may only be wagering one credit on the underlying wagering game, whereas a second player may be wagering five credits. As such, the special event can be configured so as to provide an award based on the underlying credits wagered. Thus, although the first player technically "won" by performing better over the course of the special event, the second player may receive a larger award value at the conclusion of the special event based on the higher wager values received.

The special event may be configured so as to collect all of the award values earned by each of the participants in the special event and aggregate these awards in an award pool. Based on their performance in or the outcomes of the special event, participants may earn a percentage of the aggregated award pool.

A variety of special features can be implemented according to various embodiments of the present invention. Special events are triggered during play of an underlying wagering game and a plurality of players are selected to participate in the special event. At the conclusion of the special event, one or more players are provided an award based on the result of the special event.

Trail-Based Game

Figure 4:
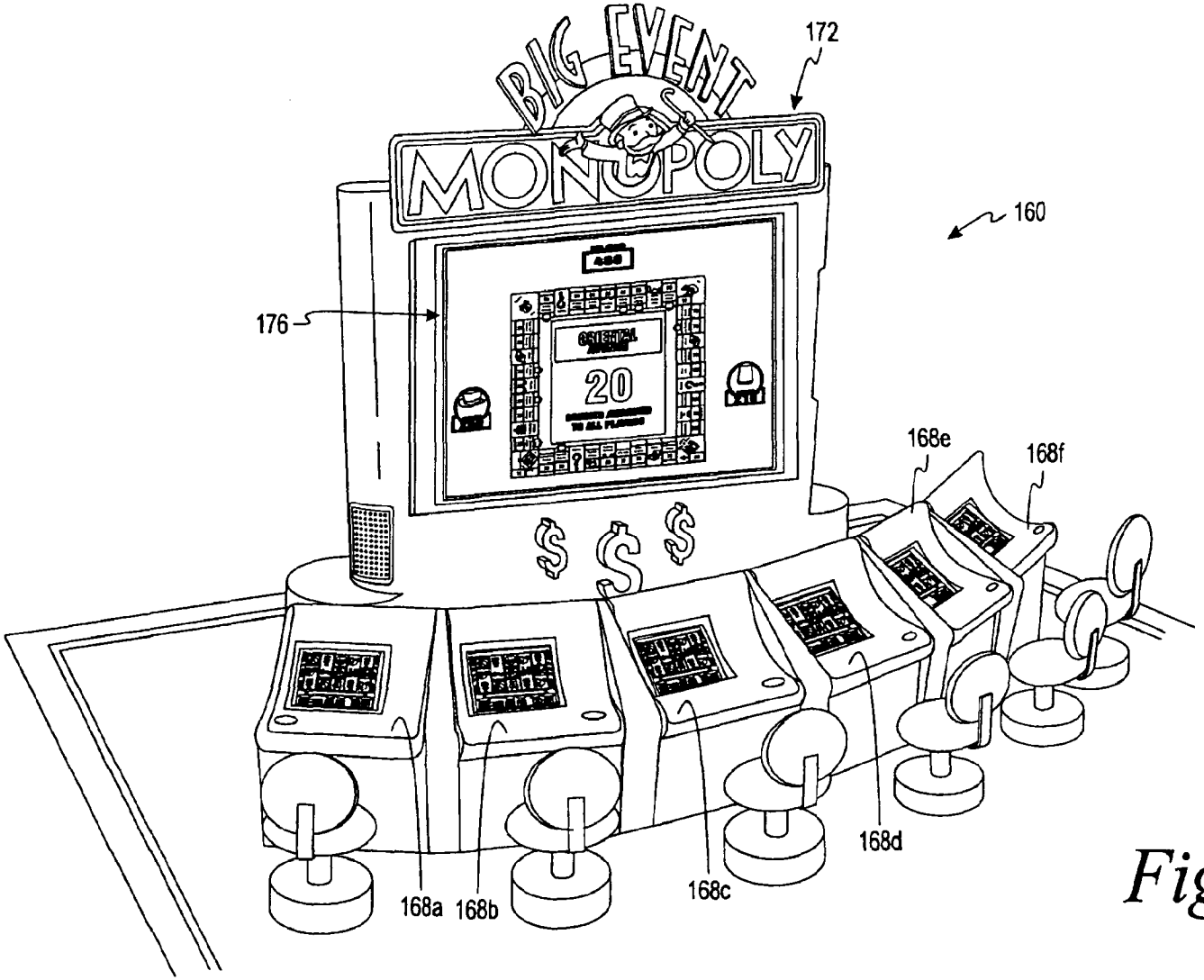
FIG. 4 is a gaming system having a bank of gaming machines, according to one embodiment of the present invention.

In some embodiments the special event may be a community event. Referring now to FIG. 4, a gaming system 160 comprising a bank of gaming machines 168*a-f* is illustrated in accord with one embodiment of the present invention. The gaming machines 168*a-f* may be of the type described above with respect to FIGS. 1*a-b*, including a combination of free-standing machines 10 and handheld machines 110, or any other type of gaming machine suitable for operating a wagering game. The gaming machines 168*a-f* are interconnected and included under signage 172. The signage 172 includes a community display 176 for displaying a community event thereon. According to one embodiment, the community display 176 is one or more plasma displays visible to each player seated at the bank of gaming machines 168*a-f*.

The signage 172 may include a signage controller (not shown) for controlling the signage 172. Alternatively or additionally, the controller 34 (FIG. 2) of one or more of the gaming machines 168*a-f* or the external systems 50 (FIG. 2) may control the signage 172. The gaming system 160 allows for various aspects of the gaming machines 168*a-f*, such as playing community events, to be utilized and displayed on the community display 176.

Figure 5:
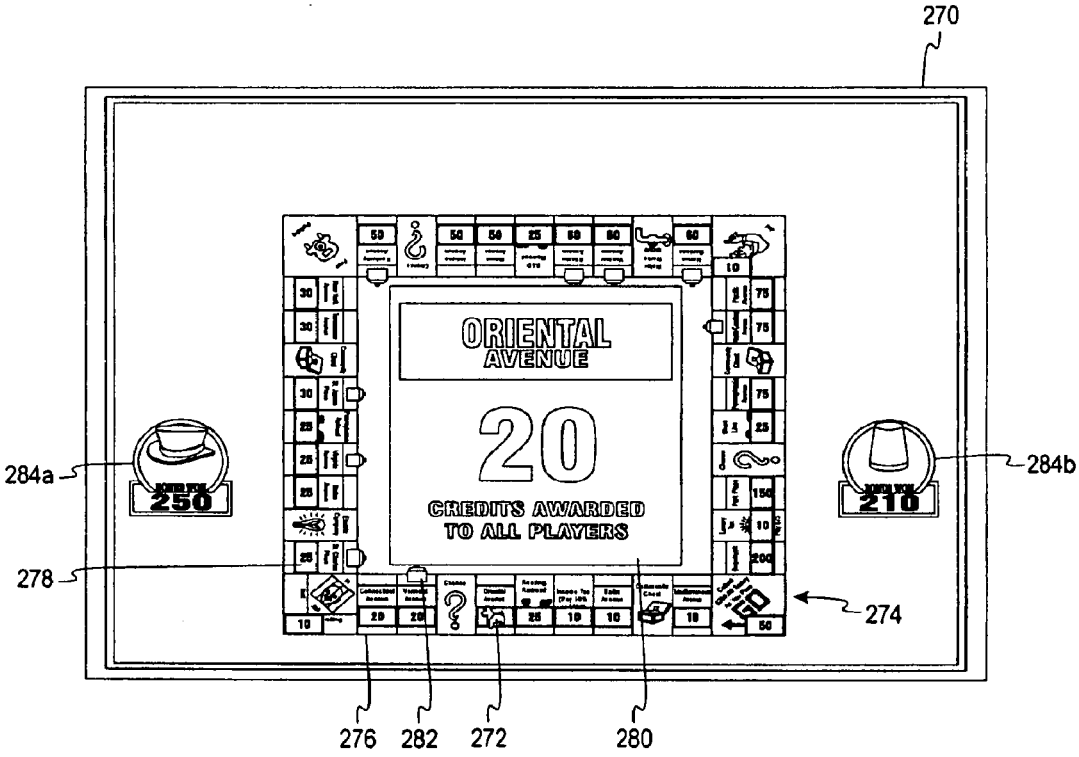
FIG. 5 is a game screen for a community trail-based game operable on the gaming system of FIG. 4.

The special event may be a community trail-based game such as the one illustrated in FIG. 5. The trail-based game includes a token 272 that is adapted to advance along a trail 274 composed of a plurality of steps 276. In one embodiment, the trail-based game is a MONOPOLY® game, the token 272 being displayed as a "dog" moving along a trail of "properties." Each of the steps 276 (e.g., properties) has a step value that may be indicated by a step-value meter 278 located within the step 276. When the token 272 lands on a particular step 276, a step indicator 280 may be displayed to better demonstrate the step value and indicate that the step value is being awarded.

Each participant may be provided with one or more markers 282 that can be placed along the trail 274. The participant may be provided with a predetermined number of markers 282 or the participant may earn markers 282 (or additional markers) through play of the underlying wagering game. The participant utilizes the markers 282 to select one or more steps 276 along the trail 274. The selection of the steps 276 may be random, predetermined by the particular marker 282 earned in the underlying wagering game, or selected by the participant.

According to one embodiment, as the token 272 advances along the trail 274, awards are earned by the participants for the various steps 276 that the token 272 comes to rest on. The step value (indicated by the step-value meter 278) may then be provided to each of the participants in the trail-based game. However, when the token lands on a step 276 having a participant's marker 282 marking it, the step value for the other participants may be reduced with the portion that is reduced being awarded to the participant whose marker occupies the step: 276. Alternatively, the entirety of the other participants step value may go to the participant who's marker occupies the step 276 (i.e., the marking participant is awarded the step value multiplied by the number of participants while the remaining participants get no award).

Figure 6:
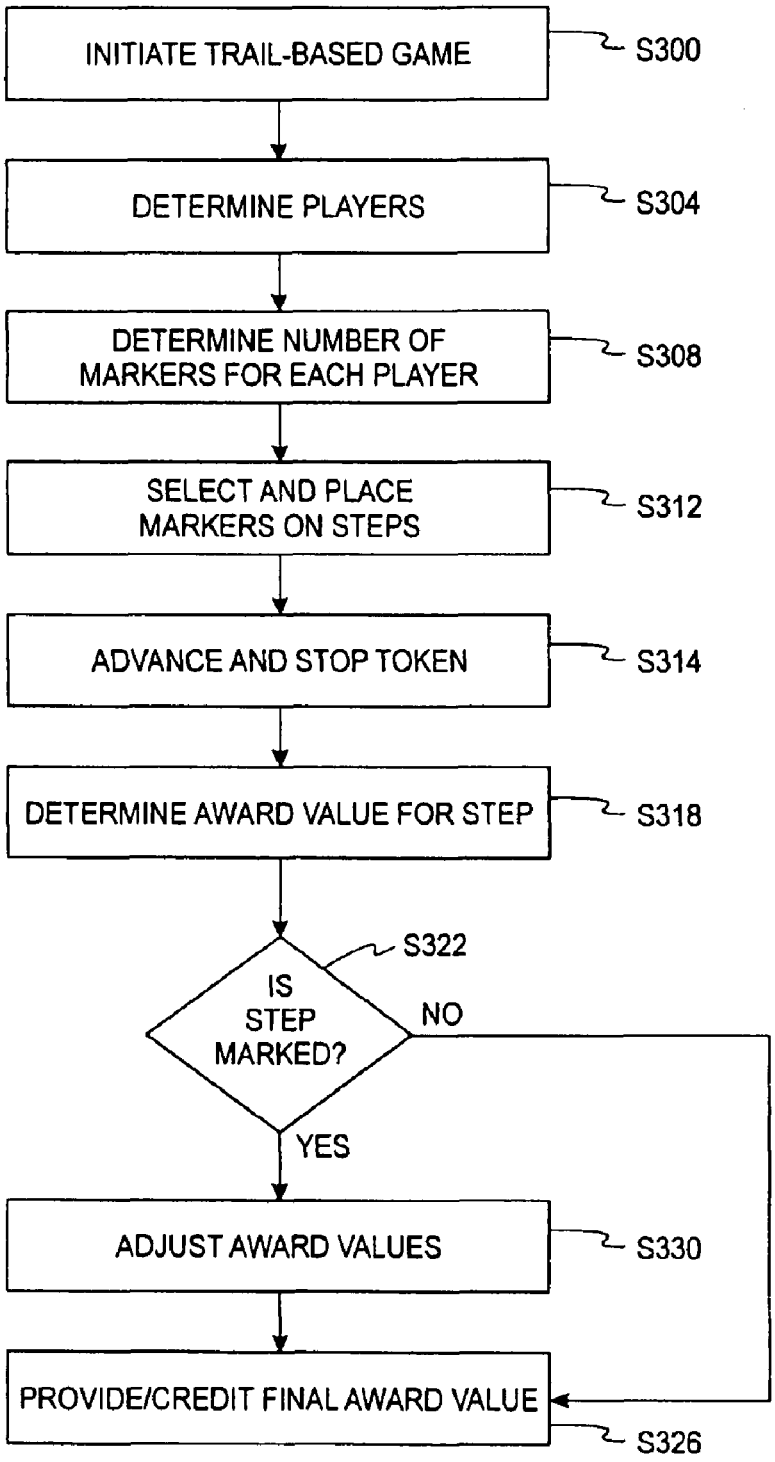
FIG. 6 represents a method for conducting a trail-based game, according to one embodiment.

Referring also to FIG. 6, a method for conducting a trail-based game is illustrated, according to one embodiment. The trail-based game is initiated at s300 during play of an underlying wagering game. Once the trail-based game has been initiated, the players that will participate in the trail-based game are determined at s304 and the number of markers 282 that each players will be receive is determined at s308. As discussed above, the markers 282 may be utilized by the players to identify particular steps 276 along the trail 274 for which the player's award value will be adjusted if the token 272 comes to rest on the identified step 276. At s312 the player selects the particular steps 276 the player wishes to identify and one or more of the player's markers 282 are placed on the selected step 276.

Once all of the players have selected their particular steps 276 and the markers 282 have been placed (or the markers 282 may be automatically placed if the player so chooses or if the time for selecting has expired), the token 272 begins to advance along the trail 274. As the token 272 advances, it stops along the way on a plurality of the steps 276 at s314. An award value is determined, at s318, for the step 276 on which the token 272 has landed.

A determination is made at decision box s322 whether the step 276 on which the token 272 has landed is marked by one or more of the players' markers 282. If the step 276 is not marked by any of the players' tokens, the award value determined at s318 is the final award value and is provided or credited (or displayed) to the players at s326. Alternatively, if a determination is made at s322 that the step 276 on which the token 272 has landed is marked, the award value determined at s318 is adjusted at s330 to determine the final award. The final award (i.e., the adjusted award) is then provided or credited to the player or players at s326. As discussed above, the award value determined at s318 may be adjusted at s330 by reducing the award value to certain players with the portion that is reduced being awarded to the player whose marker occupies the step 276. Alternatively, the adjustment at s330 may award the entirety of the other players determined award value (at s318) to the player whose marker occupies the step 276.

In some embodiments, when a determination is made at that the step 276 on which the token 272 has landed is marked, the player who has marked the step may be awarded a portion of one or more of the other players' awards that have been previously awarded during play of the trail-based game.

Turn-Based Selection

Figure 7:
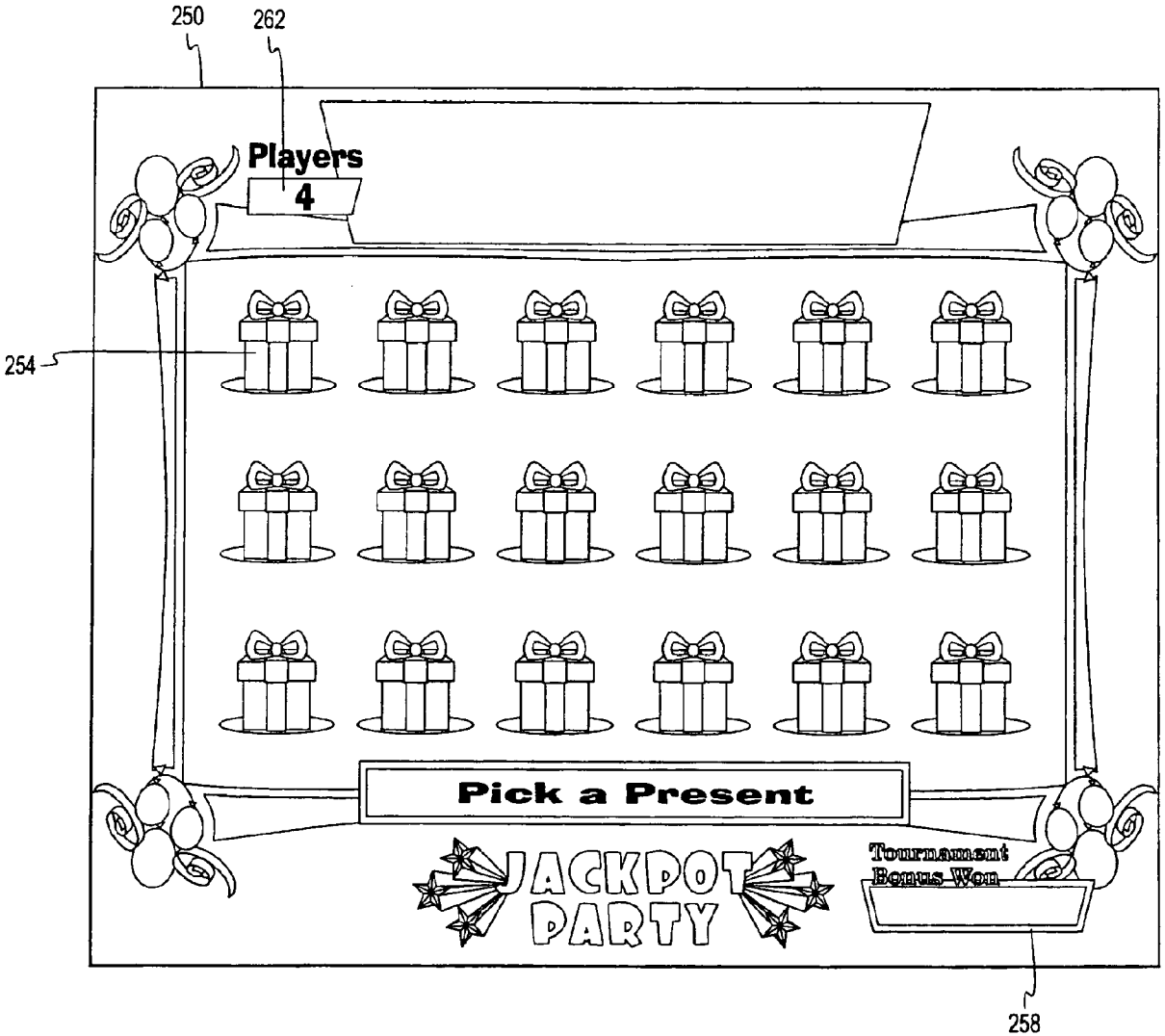
FIG. 7 is a selection screen, according to one embodiment of the present invention.
Figure 8:
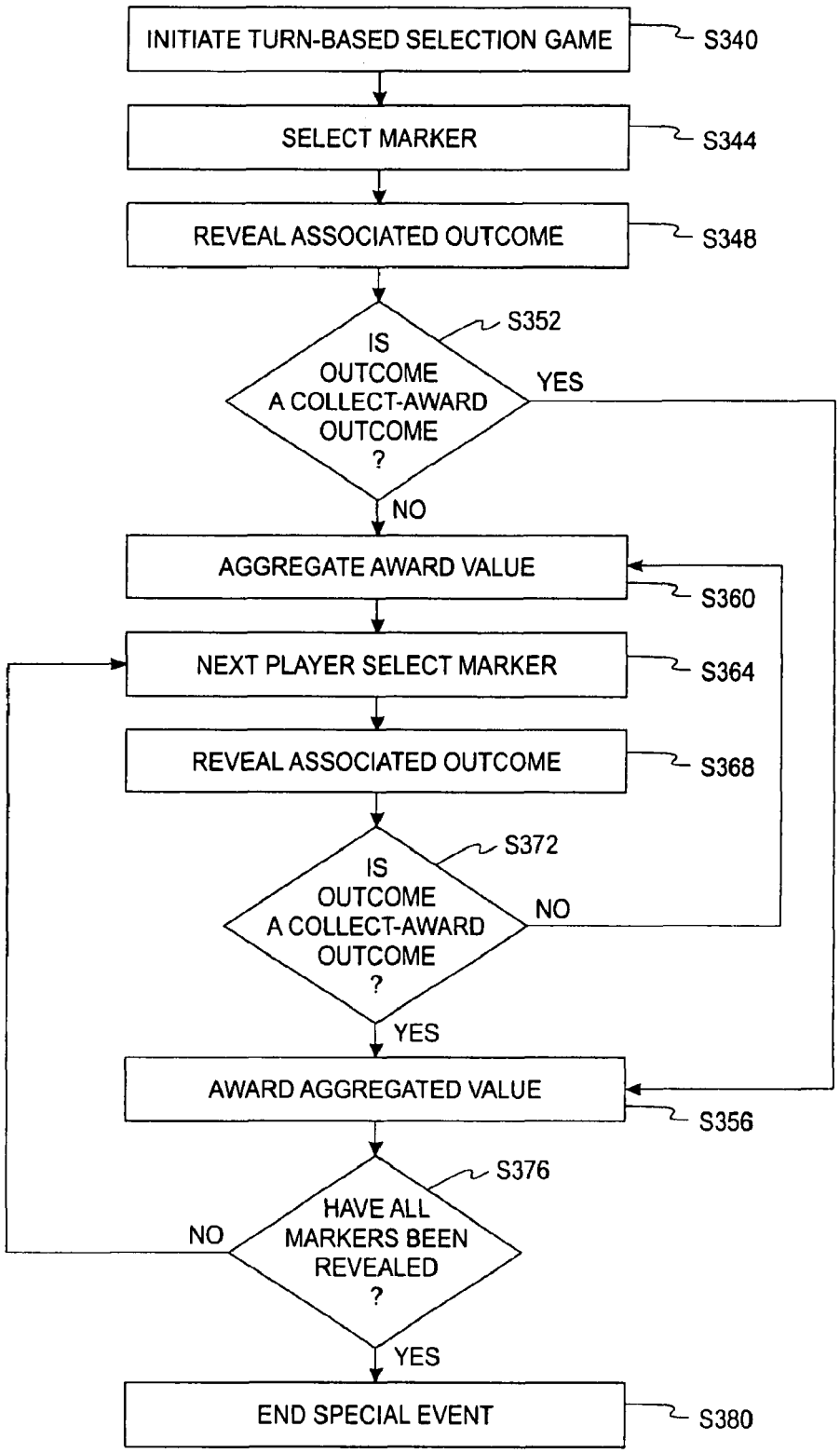
FIG. 8 represents a method for conducting a turn-based selection game, according to one embodiment of the present invention.

The special event may alternatively be a turn-based selection game such as the one illustrated in FIGS. 7-8. FIG. 7 illustrates a selection screen. 250, according to one embodiment of the present invention. The selection screen 250 includes an array composed of a plurality of markers 254 located in a plurality of columns and rows. The selection screen 250 includes a plurality of meters including a "tournament bonus won" meter 258 for displaying the number of credits previously selected by the participants and a "number of players" meter 262 for displaying the total players involved in the particular special event. The selection screen 250 may also include a more detailed tournament meter (not shown) that may contain, for example, the details for each participant (e.g., name, terminal number, terminal location, hometown, credits selected, standing, etc.).

The turn-based selection game is initiated at s340 during play of an underlying wagering game. In the turn-based selection game, a first participant selects an individual marker 254 from the array of markers at s344. Each of the markers 254 is associated with an outcome, which is revealed to the player at s348 after the player has selected the marker 254. The individual markers 254 prevent :the display of the associated individual outcome until the marker 254 has been selected by a participant. The associated outcome may be, for example, a credit value, a collect-award indicator, etc. Various credit amounts are awarded based upon which ones of the markers 254 are selected.

The bonus game may end upon selection of a marker 254 associated with a collect-award indicator but otherwise continues, allowing the participants to make further selections and accumulate further credits until encountering a collect-award indicator. A determination is made at decision box s352 whether the associated outcome of the selected marker 254 is a collect-bonus outcome. If the collect-bonus outcome was revealed at step s348, an aggregated award value (which in this case may be zero credits) is awarded at s356 to the player that selected the marker 254 at s344. Generally, the first associated outcome will be a credit value that will be aggregated to the award pool and may be displayed in the tournament-bonus-won meter 258 or a similar meter. Thus, the first outcome is generally not a collect-bonus outcome and the award value revealed at s348 is aggregated at s360 into a collective award value. The next player participating in the special event is then prompted to select a marker 254 at step s364 from the remaining unselected markers 254.

Similar to the above-described method, once the next player has selected a marker 254, the associated outcome is revealed at s368 and a determination is made at decision box s372 whether a collect-award outcome was revealed. If a collect award outcome was not selected and revealed, the award value is aggregated into the collective award value at s360 and the next player (or the first player if only two players are participating in the special event) is prompted to select one of the remaining unselected markers 254 at s364. This process continues until a determination is made at s372 that a collect-award outcome has been revealed. Once a collect-award outcome has been revealed, the collective award value, which has aggregated during the previous selections, is awarded at s356 to the player selecting the collect-award outcome.

In some embodiments, the turn-based selection game may end when a collect-award indicator is revealed. Alternatively, when a collect-award indicator is revealed, the turn-based selection game may continue until all of the markers 254 have been selected by the participants. In this embodiment, a determination is made at s376 whether all of the markers 254 have been selected by the participants in the special event. If all of the markers 254 have been selected (or no remaining credit values are masked by the markers 254), the special event is ended at s380. Alternatively, if unselected markers 254 remain, the game continues as discussed above until all of the markers 254 have been selected.

Hidden Value

Figure 9:
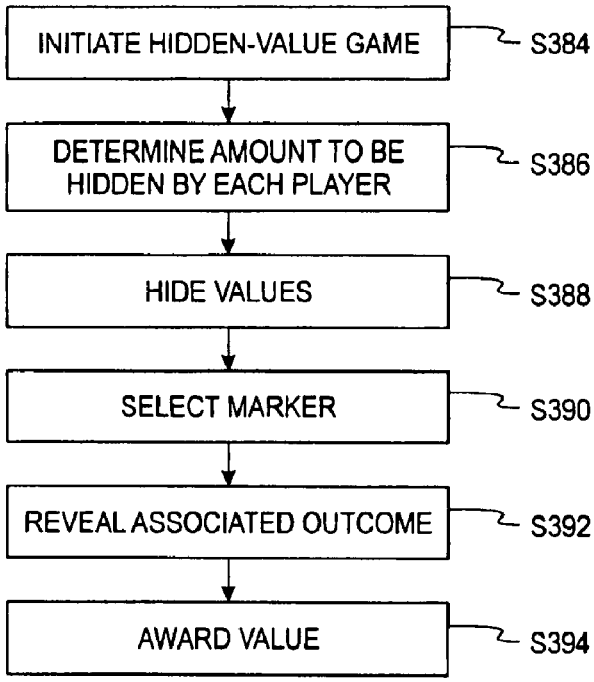
FIG. 9 represents a method for conducting a hidden-value game, according to one embodiment of the present invention.

Referring now to FIG. 7 and FIG. 9, the special event may be a hidden-value game wherein each of the participants must place a portion or all of their winnings from a particular game session (e.g., a wagering game or bonus event leading into the special event) behind one or more markers 254 positioned in an array. The hidden-value game is initiated at s384 and the amount (e.g., credits, bonus tokens, bonus items, wagers, etc.) to be hidden by each participant is determined as s386. Each participant can decide which marker or markers 254 to place their value behind at s388, and such placement is unbeknownst to the other participants. A participant may place all of their value behind a single marker 254 or may place smaller amounts behind multiple markers 254. Then, each participant selects various markers 254 at s390, which may reveal at s392 the amounts hidden by the other participants. These amounts are then credited to the participant that selected them at s394. In some embodiments, the selection of markers 254, revealing of outcomes, and awarding of value is as discussed above with respect to the turn-based selection game. Multiple participants may hide their values behind the same marker 254. Each marker that does not have a participant's value hidden behind it, may have an independent credit value associated with it or may be associated with a collect-award identifier.

Hide and Hope

Figure 10:
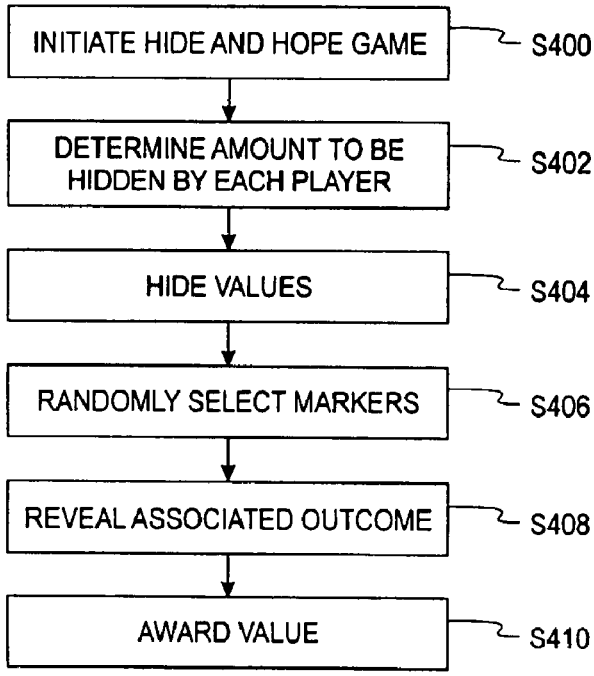
FIG. 10 represents a method for conducting a hide-and-hope game, according to one embodiment of the present invention.

The special event may be a hide-and-hope game which may be conducted as illustrated in FIG. 10. The hide-and-hope game is initiated at s400 and the amount to be hidden by each player is determined at s402. In one embodiment, each of the participants takes a portion or all of their earnings (or a predetermined amount is provided) and hides all or a portion of their determined value behind one or more marker 254 at s404. The value to be hidden by each of the players may be a random or predetermined amount provided at the initiation of the special event. Alternatively, the value may be from a wager by the player or from their earnings in an underlying wagering game. Through random selection, one or more of the markers 254 are selected at s406. As a marker 254 is selected, the values behind the marker 254 are lost, at least to the players that hid the values. The values hidden behind the remaining markers 254 at the end of the selection process remain in play and are revealed at s408. An award value is provided to one or more of the players at s410. The award value may be calculated based on the remaining values for each participant. In some embodiments, the participant with the highest remaining value may be awarded all of the remaining credits in play (or, alternatively, all of the value originally in play or all of their remaining value plus all of the value lost by the other players).

In one embodiment, the markers 254 may be barrels in which the participants are capable of hiding their earnings inside. The random selection may be implemented via an animated gorilla that wanders through the array of barrels and randomly destroys various barrels based on the results of a random-number generator. The earnings contained within the destroyed barrels disappear from the screen. Once the gorilla has left the screen, the earnings within the remaining barrels are displayed and a winner is determined as discussed above.

King of the Mountain

The special event may be a King-of-the-Mountain (KotM) game wherein the various participants earn awards over the course of one or more games. However, during the KotM game, a participant can challenge one of the other participants and wager a portion or all of the challenger's earnings against a portion or all of the challengee's earnings. The wagered portions form an award pool and, at the conclusion of the competition, a winner is declared and the winner receives the award pool.

Base Game Tournament

The special event may be a tournament including multiple rounds of the basic wagering game or another type of wagering game. For example, the special event may be a slots tournament wherein the participants are given a certain number of spins or a certain period of time to accumulate credits, bonus triggers, etc., while playing a wagering game. At the conclusion of the base-game tournament, all or a portion of the credits or other awards can be provided to the winner or winners of the base-game tournament.

Silent Auction

The special event may involve a silent auction for all or a portion of the special-event award. In this embodiment, an award value is built over time, perhaps through a progressive award or as described above. Once an auction event has been triggered, the participants are given an opportunity to "bid" for the award value. The participants may bid up to the amount of the award value. The silent auction is actually a reverse auction, where the lowest bidder wins an award. In some embodiments, the lowest bidder wins only the amount of their bid, regardless of the value of the special-event award. In other embodiments, the lowest bidder generally wins only the amount of their bid, but occasionally the full amount of the special-event award is awarded to the lowest bidder as well.

Go 4 It

The special event may be a go-4-it game wherein the participants build an award pool by playing a wagering game. The award pool may be increased incrementally by applying a portion of the participants' bets towards the pool. Like progressives generally, this award pool can be randomly earned by a participant in the special event. Alternatively, the various participants may, at any time, choose to make a run at the award pool.

To make a run at the award pool, a participant places a special wager or uses a certain number of points or earned items accumulated in the wagering game. If the outcome of the run is a success, the participant is awarded the award pool. If the outcome is not successful, however, the award pool continues to build, and now includes the special wager placed by the participant.

Race to Place

The special event may be a race to achieve a particular predetermined goal such as the collection of a predetermined number of objects, credits, etc. In one embodiment, the award pool is formed by a minimum wager provided by each participant. The award pool may be enlarged by participants wishing to make a larger wager. For example, a participant may wish to increase their wager to gain the "pole position" on the other participants. In these embodiments, as the wager of a participant increases, the number of objects or credits required to reach the goal is decreased.

Perceived Competition

The special event may be a perceived-competition game wherein the competition among players does not actually affect the end awards of the participants, but is perceptible to the participants. In one embodiment, the perceived-competition game is configured such that each participant is represented by an avatar in the form of a gladiator. The gladiators of each participant are located in a ring that is, in some embodiments, displayed on a community display. The special event includes a wagering game, for example, the wagering game of FIG. 3. The participants in the special event play the wagering game and earn awards associated with the wagering game.

One or more special symbols are provided with the plurality of moveable reels 212*a-e* during play of the special event. When one of the special symbols is earned (either along an activated payline or displayed on the array in alternative embodiments) by a participant, the special symbol causes an event or attribute to be displayed on the community display with respect to that participant's avatar. For example, the special symbol may increase the weapon's size or shape held by the gladiator, the size of the gladiator, the speed or stamina of the gladiator etc. Alternatively, the special symbol may cause the participant's gladiator to do damage to a second participant's gladiator. This damage may or may not result in a portion of the awards earned by the second participant being transferred to the first participant.

In another embodiment, each participant is represented by an avatar in the form of a person. As special symbols are earned, the "happy value" of the participant's individual avatar may increase or the special symbol may cause the avatar to perform some action, such as revealing an award while moving through a simulated real-life situation.

Tug of War

The special event may be a tug-of-war game wherein two or more participants are formed into two groups, one group per side of the rope. In some embodiments, like in the perceived-competition game, the participants can be represented visually by an avatar. The avatars are lined up on the rope and depending on the outcomes of the game the participants are wagering on, the rope is pulled to one side or the other. The tug-of-war game continues until one of the groups has reached a predetermined threshold. In some embodiments, the size of the avatar representing a participant increases as the participant's wager or multiplier increases.

Progressive Array

The special event may be a progressive-array game comprising a plurality of progressive award values displayed in an array. When the special event is triggered, each of the participants is eligible for a single one of the progressives. The progressives may be earned through one of the above-described competition events. Generally, the winner of the competition will be awarded the largest progressive and the next-best participant will get the second-largest progressive and this will continue until all of the progressives have been awarded.

Alternatively, the progressive awards may be randomly provided to the participants. In this embodiment, a plurality of indicators are used each representing a particular participant-to display which progressive award is being awarded to each of the participants. The indicators may move randomly around the progressive array for a predetermined time before eventually stopping on the various progressive values. These values are then awarded to the participants represented by the indicator.

Each of these embodiments and obvious variations thereof is contemplated as falling within the spirit and scope of the claimed invention, which is set forth in the following claims.

What is claimed is:

1. A method of conducting a wagering game on a gaming system, the method comprising:

initiating a trail-based game, the trail-based game having been triggered during play of an underlying wagering game, the trail-based game including a trail having a plurality of steps, the trail-based game further including a token being adapted to move along the trail;

providing one or more markers to each of a plurality of players, each of the one or more markers being adapted to mark at least one of the plurality of steps within the trail;

identifying at least one marked step along the trail for each of the plurality of players;

stopping the token on at least two of the plurality of steps along the trail;

determining an award value for each of the steps on which the token stops; and reducing at least a portion of the award value to one or more of the plurality of players when another of the plurality of players has marked a step of each of the steps on which the token stops.

2. The method of claim 1, wherein the quantity of the one or more markers provided to each of the plurality of players is predetermined.

3. The method of claim 1, wherein the quantity of the one or more markers provided to each of the plurality of players is a predetermined minimum, and wherein each of the players may earn additional markers through play of the underlying wagering game.

4. The method of claim 1, further comprising, awarding, to a player whose marker identifies the step, the reduced portion of the award value to the one or more players.

5. The method of claim 1, wherein the award value is reduced to zero, the entirety of the award value to the one or more players being awarded to the player whose marker identified the step.

6. A computer readable storage medium encoded with instructions for directing a gaming system to perform the method of claim 1.

7. A gaming system, comprising:

a plurality of gaming machines adapted to conduct a wagering game thereon;

signage for displaying a community event thereon, the community event being triggered by the underlying wagering game; and at least one controller in communication with the signage and the plurality of gaming machines, the controller being operative to conduct a trail-based game including a trail and a token, the trail including a plurality of steps, mark one or more of the plurality of steps with a marker, display a token on at least one of the steps, reduce an award value for the step on which the token is displayed when the step is marked by one or more markers, the award value being reduced for each of the plurality of players whose marker does not mark the step.

8. The gaming system of claim 7, wherein the controller is further operative to increase an award to a player when the step on which the token is displayed is marked by at least one of the player's markers.

9. The gaming system of claim 8, wherein the increase in the award to the player is the reduction in the award values to the remainder of the plurality of players.

10. The gaming system of claim 8, wherein the increase in the award to the player includes a portion of an award previously earned by the remainder of the plurality of players.

11. A method of conducting a wagering game on a gaming system, the method comprising:

using a value input device to accept a wager input;

in response to receiving the wager input, using one or more processors to execute one or more programs stored in one or more computer readable storage medium and to cause the displaying of a wagering game on at least one display, the wagering game including a trail-based game;

using at least one of the processors to initiate the trail-based game, the trail-based game including a trail and a token, the trail including a plurality of steps;

using at least one of the processors to provide one or more markers to each of a plurality of players, each of the one or more markers being adapted to mark at least one of the plurality of steps within the trail;

using the at least one display to identify at least one selected step along the trail for each of the plurality of players;

using at least one of the processors to move the token along the trail and to stop the token on at least one step along the trail; and using at least one of the processors to reduce an award value to one or more of the plurality of players when another of the plurality of players has marked the at least one step on which the token has stopped.

12. The method of claim 11, further comprising, using at least one of the processors to award a portion of the other players previously awarded awards to the player that has marked the at least one step on which the token has stopped.

13. The method of claim 11, further comprising using at least one of the processors to randomly select the at least one selected step.

14. The method of claim 11, further comprising using a player input device to receive a player selection for selecting the at least one selected step.

15. The method of claim 11, wherein the one or more markers are earned during play of the underlying wagering game.

16. The method of claim 15, wherein the at least one selected step is predetermined by the one or more earned markers.

17. The method of claim 11, wherein the at least one of the processors is a plurality of processors, a first one of the processors residing inside a housing of a gaming machine and a second one of the processors being located remotely from the gaming machine, the first one of the processors and the second one of the processors being in communication via a network of a gaming system.

18. A computer readable storage medium encoded with instructions for directing a gaming system to perform the method of claim 11.

* * * * *